US008881959B2

(12) United States Patent
Lenz

(10) Patent No.: US 8,881,959 B2
(45) Date of Patent: Nov. 11, 2014

(54) DISPENSING CLOSURE FOR AN OPENING OF A CONTAINER

(75) Inventor: Franz Lenz, Hinterschmiding (DE)

(73) Assignee: Aptar Freyung GmbH, Freyung (DE)

( * ) Notice: Subject to any disclaimer, the term of this patent is extended or adjusted under 35 U.S.C. 154(b) by 114 days.

(21) Appl. No.: 13/521,959

(22) PCT Filed: Jan. 13, 2010

(86) PCT No.: PCT/EP2010/000137

§ 371 (c)(1),
(2), (4) Date: Oct. 1, 2012

(87) PCT Pub. No.: WO2011/085736

PCT Pub. Date: Jul. 21, 2011

(65) Prior Publication Data

US 2013/0026188 A1 Jan. 31, 2013

(51) Int. Cl.

| | |
|---|---|
| ***B65D 47/00*** | (2006.01) |
| ***B67B 1/00*** | (2006.01) |
| ***B65D 51/18*** | (2006.01) |
| ***B65D 43/14*** | (2006.01) |
| ***B65D 47/06*** | (2006.01) |
| ***B65D 47/20*** | (2006.01) |
| ***B65D 47/08*** | (2006.01) |

(52) U.S. Cl.

CPC ..... *B65D 47/065* (2013.01); *B65D 47/2031* (2013.01); *B65D 47/0876* (2013.01)

USPC . 222/556; 222/153.07; 222/545; 222/153.14; 220/833; 220/837; 220/254.4

(58) Field of Classification Search

USPC ..... 222/556, 557, 558, 575, 571, 533, 537, 222/532, 531, 536, 212, 215, 494, 490, 491, 222/546, 153.07, 153.14, 545; 220/254.3–254.6, 780, 839, 833, 837; 215/235–237

See application file for complete search history.

(56) References Cited

U.S. PATENT DOCUMENTS

| | | | |
|---|---|---|---|
| 2,272,867 | A | 2/1942 | Cobel |
| 2,286,916 | A | 6/1942 | Loomis |

(Continued)

FOREIGN PATENT DOCUMENTS

| | | |
|---|---|---|
| DE | 43 28 935 | 3/1995 |
| EP | 0 673 852 A1 | 9/1995 |

(Continued)

OTHER PUBLICATIONS

International Search Report for corresponding PCT Application No. PCT/EP2010/000137 mailed Oct. 11, 2010.

*Primary Examiner* — Kevin P Shaver
*Assistant Examiner* — Stephanie E Willliams
(74) *Attorney, Agent, or Firm* — Wood, Phillips, Katz, Clark & Mortimer

(57) ABSTRACT

A dispensing closure is provided for an opening of a container wherein the closure has a dispensing condition of operation and a charging condition of operation, a neck structure (7) for fixing the closure to a container or for being fixed to a container, an outlet port (3) communicating with the opening, an actuator (9) movably mounted on the neck structure, and a deck structure (13) extending from the neck structure transversely over the opening and forming a discharge channel (61) extending substantially linearly from the outlet port to the opening and defining a longitudinal discharge direction and the longitudinal discharge direction of the discharge channel is inclined to a horizontal (H) in an acute inclination angle (alpha) and the dispensing condition of operation the deck structure is immovably fixed to the neck structure.

19 Claims, 4 Drawing Sheets

(56) References Cited

U.S. PATENT DOCUMENTS

| | | | | | |
|---|---|---|---|---|---|
| 2,312,380 | A | | 3/1943 | Bernhardt | |
| 3,516,581 | A | * | 6/1970 | Micallef | 222/529 |
| 3,542,256 | A | * | 11/1970 | Waterman | 222/484 |
| 4,776,501 | A | * | 10/1988 | Ostrowsky | 222/517 |
| 5,284,264 | A | * | 2/1994 | Gross | 215/237 |
| 5,314,093 | A | * | 5/1994 | Gross et al. | 222/153.14 |
| 5,662,245 | A | | 9/1997 | Grant | |
| 6,152,324 | A | * | 11/2000 | Baudin | 222/1 |
| 6,460,729 | B2 | * | 10/2002 | Beecroft | 222/1 |
| 6,564,978 | B1 | * | 5/2003 | Safian et al. | 222/534 |
| 6,786,363 | B1 | * | 9/2004 | Lohrman | 222/213 |
| 2002/0113097 | A1 | * | 8/2002 | Harriman et al. | 222/534 |
| 2004/0112927 | A1 | * | 6/2004 | Kaufman et al. | 222/531 |
| 2004/0159684 | A1 | * | 8/2004 | Roberts et al. | 222/556 |

FOREIGN PATENT DOCUMENTS

| | | | |
|---|---|---|---|
| EP | 1 321 375 | A2 | 6/2003 |
| WO | 9858847 | | 12/1998 |
| WO | 2009/028491 | A1 | 3/2009 |

* cited by examiner

DISPENSING CLOSURE FOR AN OPENING OF A CONTAINER

FIELD OF THE INVENTION

The invention relates to a dispensing closure for an opening of a container, particularly to a toggle-action dispensing closure for a container, wherein the closure can be manually manipulated between a closed horizontal orientation and an opened tilted dispensing orientation.

BACKGROUND OF THE INVENTION

Different closure designs have been proposed for a container used with flowable substances. Said closure type usually is provided for being attached to a container neck or mouth wherein the closure includes a so-called toggle-action actuator, flip-up spout, or a nozzle assembly for emitting the flowable content. Usually, such known dispensing closure comprises a dispensing condition of operation. In this dispensing condition of operation, the toggle-action actuator is tilted such that a fluid communication between the interior and the exterior of the container is established. For fixing the closure to the container, the dispensing closure comprises a neck structure. Said neck structure can as a separate element be mounted to the container or can be realized integrally with the mouth or the neck of the container. Usually, a dispensing closure defines a final outlet port from which the flowable content exits the dispensing closure to the exterior of the closure. The known dispensing closure comprises a movable actuator, particularly a toggle-action actuator, that is movably supported on said neck structure between a closed position for occluding said outlet port and an open position for vacating said outlet port in order to permit the content of the container to flow out of the opening of the container. In order to bring the actuator in its respective position, a particularly manual force is to be applied to said actuator by an end user. Further, the known dispensing closure comprises a deck structure extending from said neck structure transversally over said opening of the container. The deck structure forms a discharge channel extending substantially linearly between said outlet port and said opening and defining a longitudinal discharge direction. Said discharge channel starts at an inlet port adjacent the opening of the container and extends linearly.

Such a dispensing closure is for example known from U.S. Pat. No. 6,832,700 B2 in which according to its FIG. 7, the discharge channel formed by the deck structure extends linearly from its inlet port in a vertical direction and ends in a further channel branch formed in the toggle-action actuator. Said channel branch or prolongation formed by the toggle-action actuator is orientated horizontally in the closed position of the toggle-action actuator and is tilted with respect to the horizontal in the opened position. According to the structure of U.S. Pat. No. 6,832,700 B2, the outlet port of the closure is confined by the toggle-action actuator and accordingly moves together with the toggle-action actuator between the open and closed position in which the outlet port is closed by a fixed wall portion of the neck structure. Consequently, since the discharge channel is formed both by the fixed deck structure and by the moving toggle-action actuator, care must be taken regarding the cross-over between the channel portions of the movable toggle-action actuator and the fixed deck structure. It turns out that flowable content could leave the discharging channel in the cross over because of sealing difficulties and could therefore could reach internal compartments of the dispensing closure outside the discharge channel. For the end user it is quite cumbersome to clean the dispensing closure from this leaked flowable content so that the known dispensing closure might suffer hygienical problems if flowable content leaks from the discharge channel. A further disadvantage of the known dispensing closure could be identified when handling the dispensing closure. In a closed position of the toggle-action actuator, the channel portion adjacent to the outlet port is horizontal such that, if the container rests in an upright upside-down position, the fluid pressure in the flowable medium at the outlet changes when the toggle-action actuator is tilted and brought into the open position in which said discharging channel portion of the actuator adjacent the outlet is inclined. This abrupt change of pressure within the flowable content between the opened and the closed position makes the handling of the dispensing closure particularly regarding the dispensing speed of the flowable content unpredictable for a end user.

BRIEF SUMMARY OF THE INVENTION

It is an object of the invention to overcome the disadvantages of the prior art, particularly to provide a dispensing closure for an opening of a container according to the first part of independent claim 1 which provides hygienic operation condition during the entire using time of the dispensing closure while improving the handling of the dispensing closure, particularly when opening the actuator.

This object is solved by the features of claim 1. According to the invention, the discharge channel extending substantially continuously linearly from said outlet port to said opening of the container defines a longitudinal discharge direction. Said discharge direction is particularly straight and inclined to a horizontal in an acute inclination angle. Further, in the dispensing condition of operation, i.e. when the actuator is moved into the opened position in order to vacate said outlet port, the deck structure is immovably fixed to the neck structure in between said actuator and the neck structure such that regardless the position of the actuator the inclination angle does not change. One aspect of the invention refers to the acute inclination angle of the longitudinal discharge direction of discharge channel with respect to the horizontal. According to the invention, the entire discharge channel structure extending from the inlet end to the outlet end is exclusively confined by the deck structure. No element or material of the movable toggle-action actuator confines the discharge channel.

The horizontal is defined by a plane to which the direction of gravitation is perpendicular. If the container is in an upright position, usually, its longitudinal direction or center axis of the container as well as of the dispensing closure is coincident with the direction of gravitation. The horizontal is perpendicular to such longitudinal direction.

It shall be clear that the deck structure must not be unreleasably fixed to the neck structure in any condition of operation, however, according to above first aspect of invention, the deck structure must be immovably fixed to the neck structure when the dispensing closure is in its active action for dispensing flowable content of the container, i.e. in its dispensing condition of operation. For the charging condition of operation, it is possible to release the immovable fixation of a deck structure to the neck structure in order to completely free the opening of the container for an easy access.

By providing a constant acute inclination angle regarding the longitudinal discharge direction of the discharge channel with respect to the horizontal during the entire dispensing condition of operation, the fluid pressure in the flowable content within the linear discharge channel also remains stable even when operating the movable actuator. Therefore, the end user will experience uniform dispensing conditions that will not change when opening the movable actuator and the dispensing speed can easily be controlled by squeezing forces as applied by the end user. Therefore, the dispensing closure provides a predictable handling when opening the actuator of the dispensing closure. Further, as the discharge channel does not comprise any relative movement between channel portions, i.e. any relative movement of elements forming the discharge channel is prohibited, a leakage of flowable content along the discharge channel is avoided.

In the preferred embodiment of the invention, the actuator forms a particularly flat outside ring or surface, particularly a top flat outside surface. Said outside surface is designed for depositing the container in an upright up-side-down position in which the flowable content flows under the influence of gravitation to the dispensing closure, the discharge channel and to the outlet port. As soon as the end user forces the actuator in the open position and pushes the squeezable container, content can flow out of the outlet of the dispensing closure, without any delay. In the closed position of the movable actuator, the flat outside surface lies in a horizontal plane, i.e. the discharge channel is inclined to said flat horizontal outside surface so that, even in the closed position of the actuator, because of gravitation forces, vertical pressure components force the flowable content to the outlet port, however, because of the inclination of the discharge channel, the horizontal components reduce the gravitational forces pushing the content to the outlet port. In the open position of the actuator, the flat outside surface is inclined to the horizontal in an acute open angle that is larger than the inclination angle of the longitudinal discharge direction of the discharge channel.

In a preferred embodiment of the invention, the inclination angle is between about 1° to about 85°, preferably about 5° to about 60°, or smaller than about 45°, particularly to about 10° to 30°.

In a further embodiment of the invention, the discharge channel is confined by an at least partly revolving channel wall. The revolving channel wall can have a cylindrical or a particularly slightly cone shaped form. Preferably, the channel cross section increases constantly particularly from the inlet port adjacent to the opening of the container to the outlet port.

In a preferred embodiment of the invention, said discharge channel defines an inlet port formed by the deck structure. Said inlet port faces said opening while the outlet port is averted from the opening of the container. The inlet port can be at least partly confined by a horizontal wall of the deck structure. Particularly, the discharge channel extends with its horizontal component of direction radially outwardly to the circumference of the closure. The inlet port can have an annular cross section being coincident to a center axis of the opening of the container. However, alternatively, the center line of the inlet can be offset to the center axis of the opening. However, the discharge channel, particularly the longitudinal discharge direction of the discharge channel, extends linearly straight essentially from the inlet port radially away from the centerline of the opening. Preferably, the horizontal component of direction of discharge channel shall be dimensioned smaller than the radius of the circularly shaped dispensing closure body.

In a second independent aspect of the invention which aspect can also be combined with the first independent aspect of the invention, the inventor intends to improve the known dispensing closure according to U.S. Pat. No. 6,832,700 B2 regarding a charging condition of operation for the closure. It is desirably to provide a dispensing closure which must not completely be demounted if the container, to which the dispensing closure is fixed, shall be refilled with flowable content. In the known structure, it is possible to demount the toggle-action actuator in order to get access to the vertical branch of the discharge channel formed only by the deck structure, still covering the majority of the opening, said vertical portion provides a more or less large introduction opening for the flow content. However, when demounting the toggle-action actuator there is a risk of damaging elements of the dispensing closure.

Therefore, it is a further object of the invention to overcome the disadvantages of the known dispensing closure, particularly, to provide a dispensing disclosure having not only a dispensing condition of operation but a charging condition of operation which can easily be established while a large amount of flowable content can be charged.

This object is to be solved by the features of independent claim 6. According to the invention, the dispensing closure comprises a neck structure for fixing the closure to the container or for being fixed to the container. Further, the dispensing closure comprises a deck structure being fixed to the neck structure for said dispensing condition of operation. In this fixed mounting position, the deck structure extends from said neck structure transversally over said opening of the container and defines a discharge channel. The dispensing closure comprises a movable actuator occluding said discharge channel in a closed position and vacating said discharge channel in an open position. The movable actuator can be movably supported on the neck structure. Further, the dispensing closure according to the invention comprises a first pivot joint for pivotably supporting the actuator on said neck structure. Further, a locking means is provided for releasably fixing the deck structure to the neck structure. A second pivot joint is provided for pivotably connecting said deck structure and neck structure. The deck structure is arranged between the actuator and the neck structure in such a way that when the actuator is detached from the neck structure and the locking means are released, the deck structure can be pivoted via said second pivot joint between said mounting position and a release position in which the opening of the container is essentially uncovered by the deck structure. Through the essentially uncovered opening of the container, the last can easily be charged with the flowable content.

The invention provides a sandwich arrangement of the neck structure to be fixed to the container, a deck structure forming the discharge channel and the movable actuator, particularly the toggle-action actuator. The sandwich arrangement permits movement of the three components with respect to each other by the first and second pivot joint. By this structure, it is easy for the end user to identify the dispensing condition of operation and to activate the charging condition of operation. However, for the end user the dispensing condition of operation is more apparent and the charging condition of operation are hidden behind the structure responsible for the dispensing condition of operation. The second pivot joint can only be activated after the locking means fixing the deck structure to the neck structure is released.

In a preferred embodiment of the invention, said first pivot joint comprises a pair of pivot pins each retained on an engaging wall portion of the actuator. Preferably, said engaging wall portion of the actuator overlaps the outside of a receiving wall portion of a neck structure so that for demounting the actuator, an external access to the overlapping wall portions of the first pivot joint is achieved. Particularly, the engaging wall portion of the actuator and the receiving wall portion of a neck structure are shaped complementarily.

In a further development of the invention, both engaging wall portions of the first pivot joint are elastically deformable such that they can be spread radially outwardly for disengaging the pivot pins from respective pivot holes formed in the neck structure.

Preferably, said first pivot joint comprises a snap means having at least two snap positions defining the open and closed position of the actuator.

According to a preferred embodiment of the invention, both pivot joints define each a pivot axis which are parallel to each other.

In a preferred embodiment of the invention, the second pivot joint is a film hinge.

Preferably, the second pivot joint is arranged diametrically oppositely to the outlet port of the dispensing closure.

In a preferred embodiment of the invention, the second pivot joint, a pair of pivot pins for the first pivot joint and the outlet port are positioned essentially in identical perimeter distances, particularly of about 90° around a center axis (L) of the closure.

In a further development of the invention, a locking means is formed by an annually deformable catch or hook that in said mounting position of the deck structure snappingly engages a ring wall of the neck structure particularly having an undercut, for releasingly fixing the deck structure to the neck structure. For releasing, the deformable catch or hook are deformed radially inwardly in order to free the undercut of the ring wall of the neck structure.

In a preferred embodiment of invention, the neck structure and the deck structure are integrally formed of one piece of plastic.

In a further development of the invention, a valve is positioned at the outlet port of the discharge channel. Said valve is particularly realized by a slotted roll diaphragm.

In a preferred embodiment of the invention, the revolving channel wall portion is formed with a seat for receiving said valve that particularly is retained in the seat ring, preferably by a snap or press ring, or alternatively is moulded with said seat by using a tow-component injecting moulding.

According to a further development of the invention, both the deck structure and the neck structure comprise a partly spherical outside wall being formed to shape a partly spherical axis-symmetric body for the closure. The cross overline between the neck structure and the deck structure defines the equator or the symmetric axis plane of the spherical body of the closure.

In a preferred embodiment of the invention, the neck structure comprises a partly spherical recess in a spherical outside wall portion for receiving a corresponding spherical outside wall portion of the actuator in its open position. Particularly, a depth of the recess corresponds essentially to a thickness of the received outside wall portion of the actuator.

Preferably, said recess is confined by a shoulder acting as a stop for limiting the pivoting of the actuator and defining the open position of the actuator.

BRIEF DESCRIPTION OF THE DRAWINGS

Further features, functions and advantages of the invention are described by the following description of a preferred embodiment of the invention by means of the enclosed figures in which.

DETAILED DESCRIPTION OF THE PREFERRED EMBODIMENTS

For each of the following description, the dispensing closure of the invention is described in an upright position in terms such as upper, lower, horizontal, vertical (=longitudinal) etc. are used with reference to this position. It is to be understood, however, that the dispensing closure of the invention may be manufactured, stored, supported, used, and sold in an orientation other than the position described.

Figure 1:
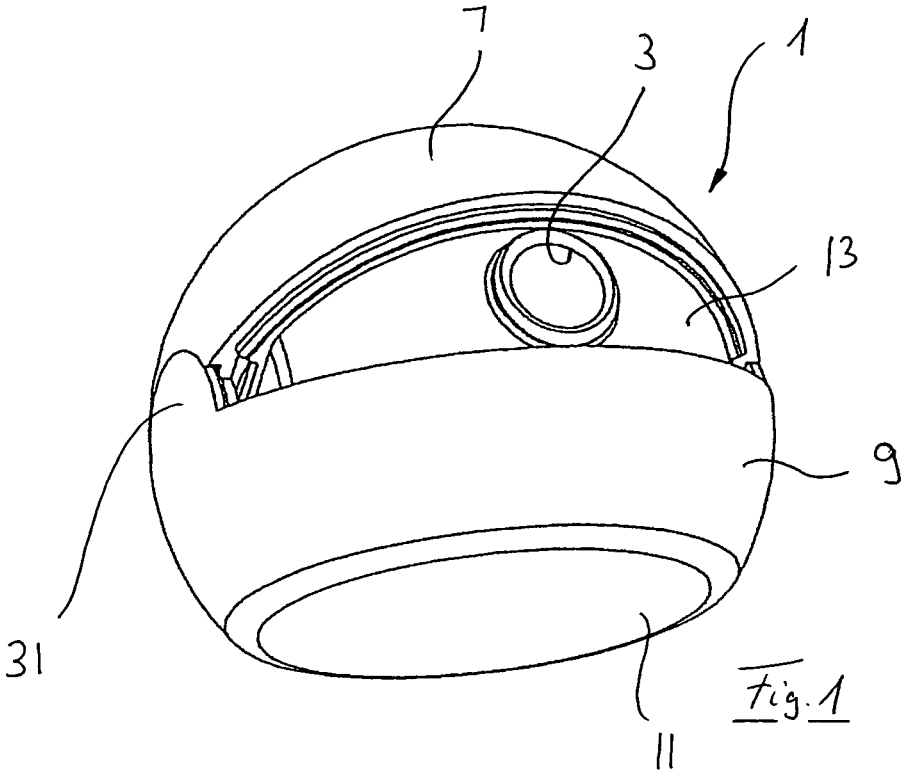
FIG. 1 is a perspective view of the dispensing closure of the present invention shown in a dispensing condition of operation.
Figure 2:
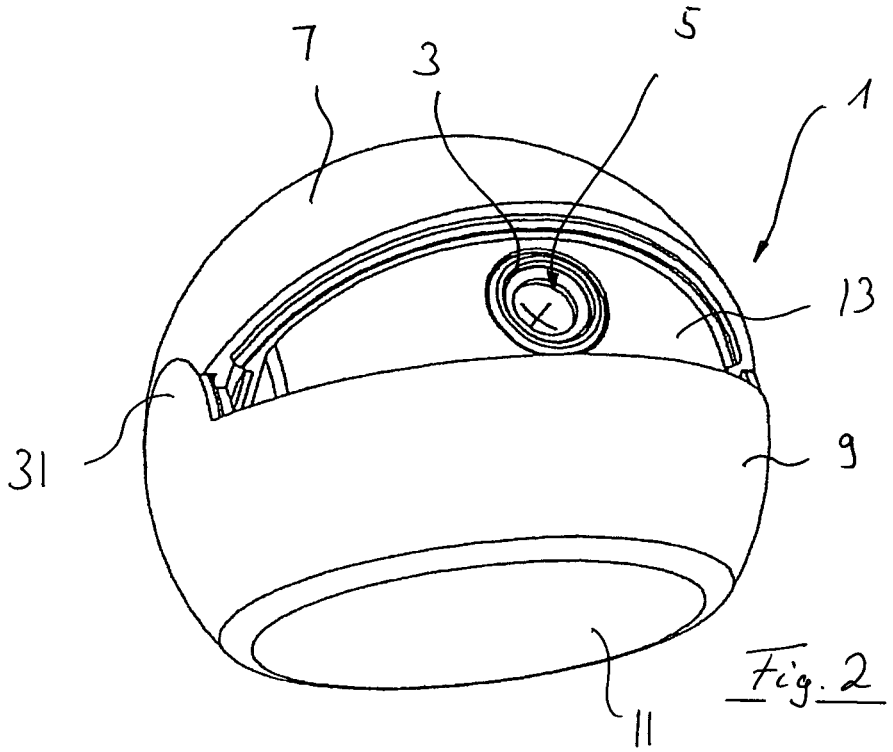
FIG. 2 is a perspective view of the dispensing closure shown in FIG. 1 additionally having an elastomeric valve at the outlet port.

FIGS. 1 and 2 show an embodiment of the dispensing closure of the invention in an open position in the dispensing condition of operation. The dispensing closure is provided with reference number 1 and can be fixed to a container (not shown) holding a flowable medium. For the sake of a clear description, during the entire description of figures, for similar or identical elements of the dispensing closure, the same reference numbers will be used.

The dispensing closure 1 of FIG. 1 differs from the dispensing closure 1 according to FIG. 2 in that at the outlet 3 no valve is arranged. The valve 5 according to FIG. 2 can be realized as elastomeric rolling sleeve having a slotted orifice as it is described in references EP 0 794 126 B1 or EP 0 545 678 B1 which shall be incorporated as references in this application documents.

Figure 3:
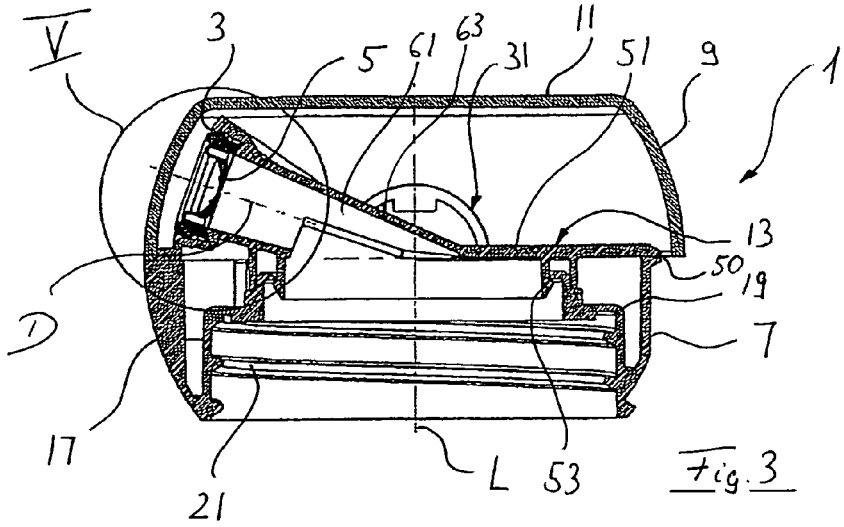
FIG. 3 is a cross sectional view of the dispensing closure according to FIG. 2 in a closed position.

The dispensing closure 1 comprises as main components: a neck structure 7, a toggle-action actuator 9 having a flat top surface 11 on which the dispensing closure and the container (not shown) can be deposited in an up-right-down-position. Further, the closure 1 comprises as a main component a deck structure which is positioned between the toggle-action actuator 9 and the neck structure 7. The deck structure 13 is completely covered by the toggle-action actuator 9 in its closed position which is shown in FIG. 3. The total body of the dispensing closure formed by the neck structure 7, deck structure 13 and toggle-action actuator 9 forms a sandwich arrangement which is best visible in FIGS. 3 and 4.

The detailed construction of the dispensing closure can be best described in view of enclosed FIGS. 3 to 9, to which it is now preferably referenced.

The neck structure 7 comprises an outer wall section 17 and an inner wall section 19. The inner wall section 19 is provided with an internal thread 21 for fixing the closure 1 to the non shown container by screwing the closure 1 on a neck or mouth of the container having an external thread (not shown). The external wall section 17 is partly formed spherical.

Further, the inner wall section 19 defines a charging opening 23 which is formed circularly and concentric to the longitudinal axis L of the dispensing closure 1. The charging opening 23 is confined by a circular protrusion 25 extending radially inwardly and forming an undercut 24.

The toggle-action actuator 9 is pivotably supported on the neck structure 7 via a first pivot joint 31 which defines a horizontal pivot axis $P_1$ which extends horizontally and perpendicularly to the longitudinal axis L of the dispensing closure 1. The centered pivot axis $P_1$ of the pivot joint 31 is formed by a pair of hinges formed on diametrically opposite positions at the perimeter of the neck structure 7 and the actuator 9. The hinges comprise each a receiving wall portion 33 each forming a pivot hole 35 in which a pivot pin 37 of the toggle-action actuator is received (refer to FIGS. 7, 8 and 9). In order to provide an easy mounting operation of the toggle-action actuator 9 onto the neck structure 7, the receiving wall portion 33 comprises a vertical passage 41 cooperating with a slanted inner surface 43 formed at the pivot pin 37. Further, the receiving wall portion 33 comprises two depressions 45 for defining the open position and the closed position of the toggle-action actuator 9 and which cooperates with protrusion 47 formed adjacent to the pivot pin 37 (FIG. 9).

Figure 7:
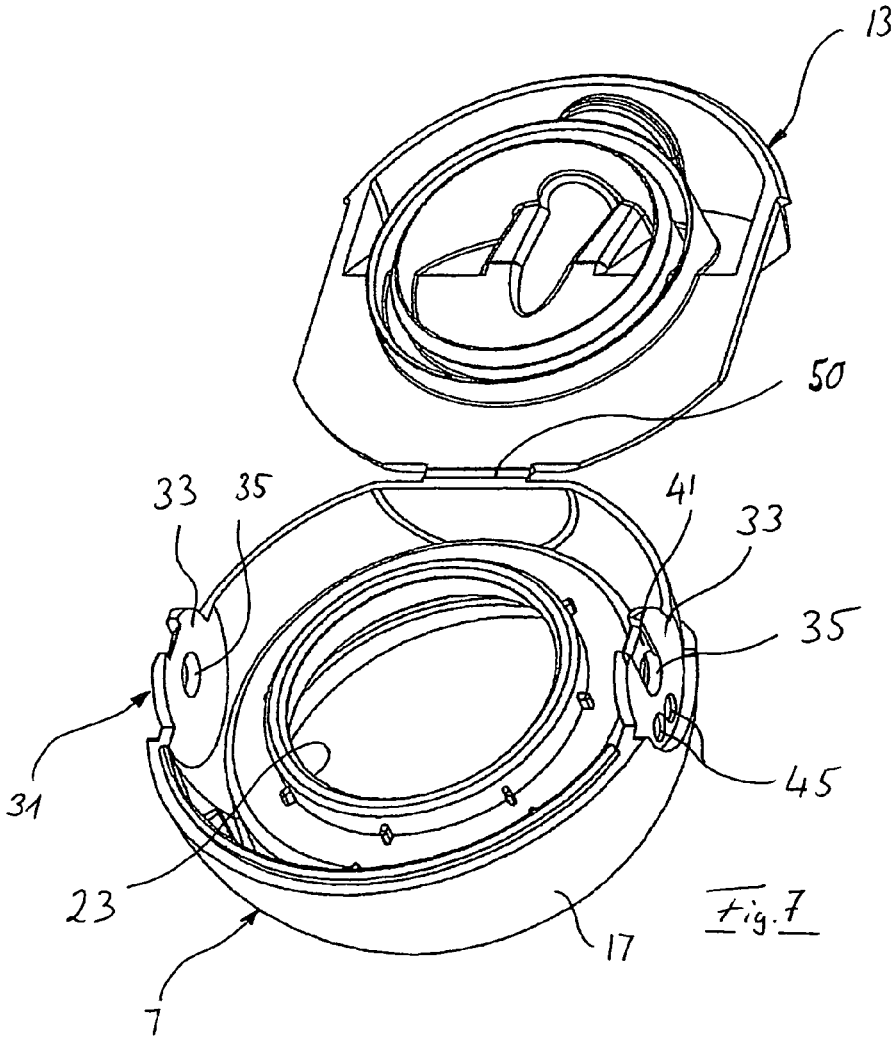
FIG. 7 is a perspective view of the main part according to FIG. 6.
Figure 8:
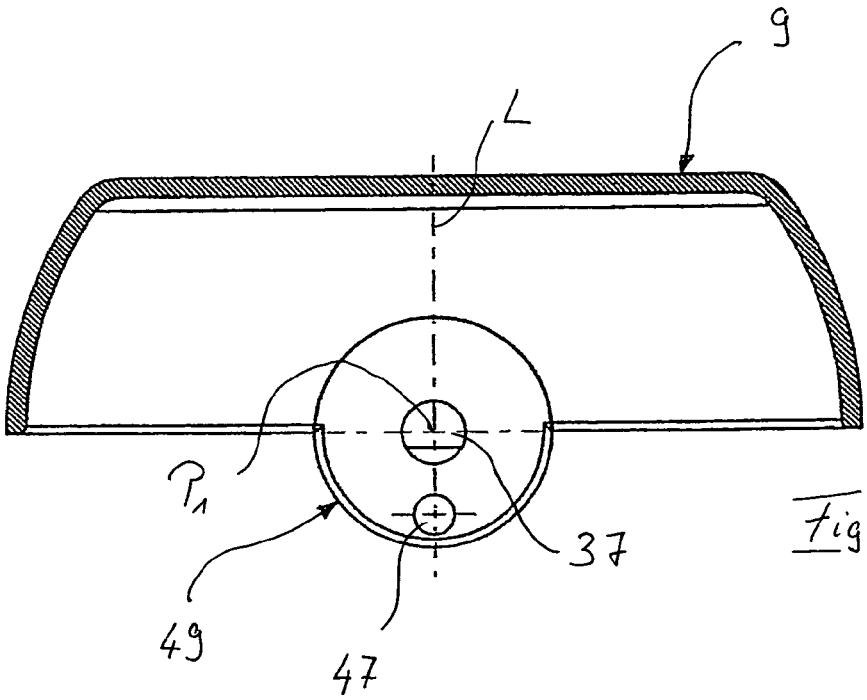
FIG. 8 is a cross sectional view of a toggle-action actuator of the dispensing closure according to FIGS. 1 and 2.
Figure 9:
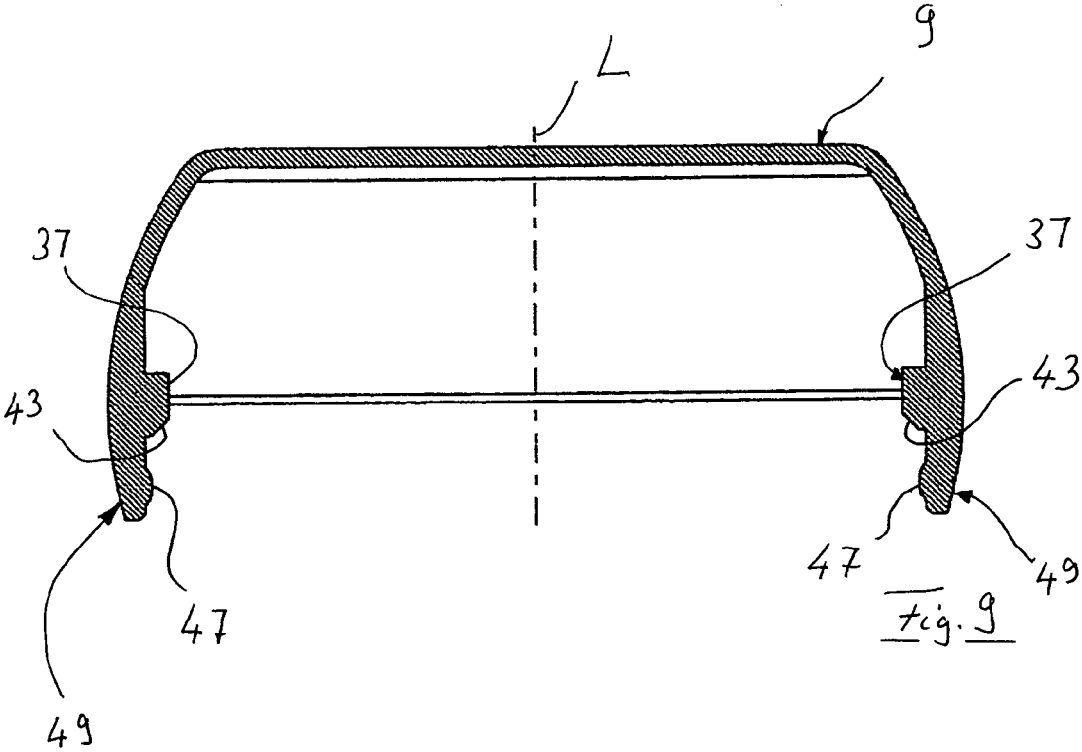
FIG. 9 is a further cross sectional view of the toggle-action actuator according to FIG. 8.

As is visible in FIGS. 7, 8, and 9, for realizing the hinges of first pivot joint 31 the toggle-action actuator 9 comprises an outer engaging wall portion 49 complementarily formed to the inner receiving wall portion 33 of the neck structure 7. The engaging wall portion 49 of the toggle-action actuator 9 is dimensioned such that it overlaps the entire outside of the receiving wall portion 33 of the deck structure, such that the hinges the outside surfaces of the neck structure 7 and the toggle-action actuator 9 forms a smooth continued spherical outside surface without forming any steps in the crossover region. The toggle-action actuator 9 is designed in an elastically deformable way such that for mounting purposes the engaging wall portions 49 can be spread radially outwardly such that the slanted surface 43 of the pivot pin 37 supports spreading by sliding along the vertical passage 41 until the pivot pin 37 snaps self-actingly into the pivot hole 35. For demounting the toggle-action actuator 9, said engaging wall portions 49 are elastically spread radial outwardly for releasing the pivot pin 37 from the pivot holes 35.

Figure 6:
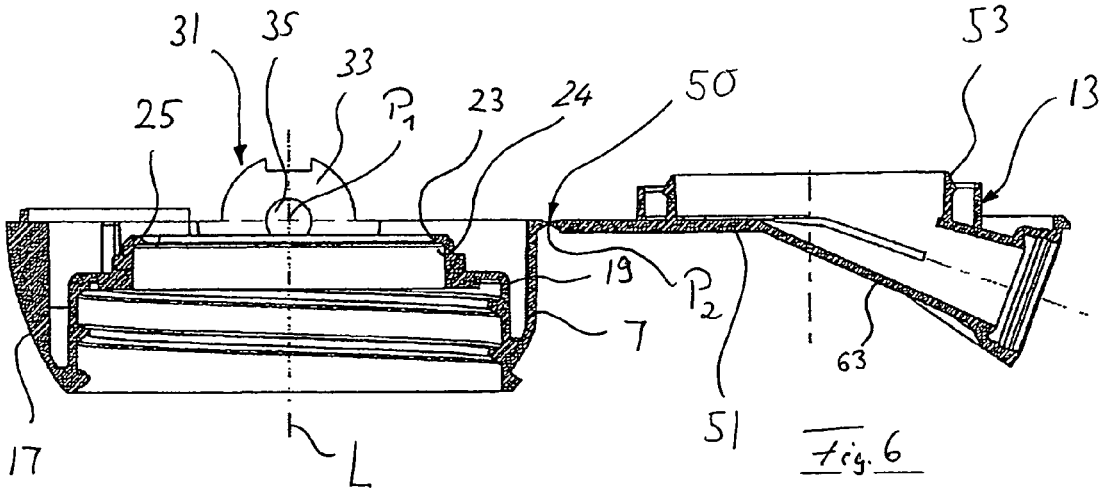
FIG. 6 is a cross sectional view of one main part of the dispensing closure according to the invention showing the charging condition of operation.

As visible in FIGS. 6 and 7, the deck structure 13 is joined to the neck structure 7 via a film hinge 50 defining a second horizontal pivot axis $P_2$ which is parallel to the pivot axis $P_1$ of the first pivot joint and lies in the same horizontal plane. In order to facilitate the fabrication process, the neck structure 7 and the deck structure 13 can be integrally injected by a single piece of plastic.

The deck structure 13 comprises a horizontal basic wall 51 (FIG. 6), which is dimensioned to cover the majority of the non shown opening of the container. From the basic wall 51, an annular locking hook 53 extends. Said annular hook 53 cooperates with the undercut 24 of the protrusion 25 into the discharge hole 23 in order to immovably fix the deck structure 13 to the neck structure 17 for creating the dispensing condition of operation.

In FIG. 6, the locking hook 53 is released from the protrusion 25 and the deck structure 13 is pivoted to the completely open charging position in which free access to the charging opening 23 is effected for pouring the flowable medium into the container.

Figure 4:
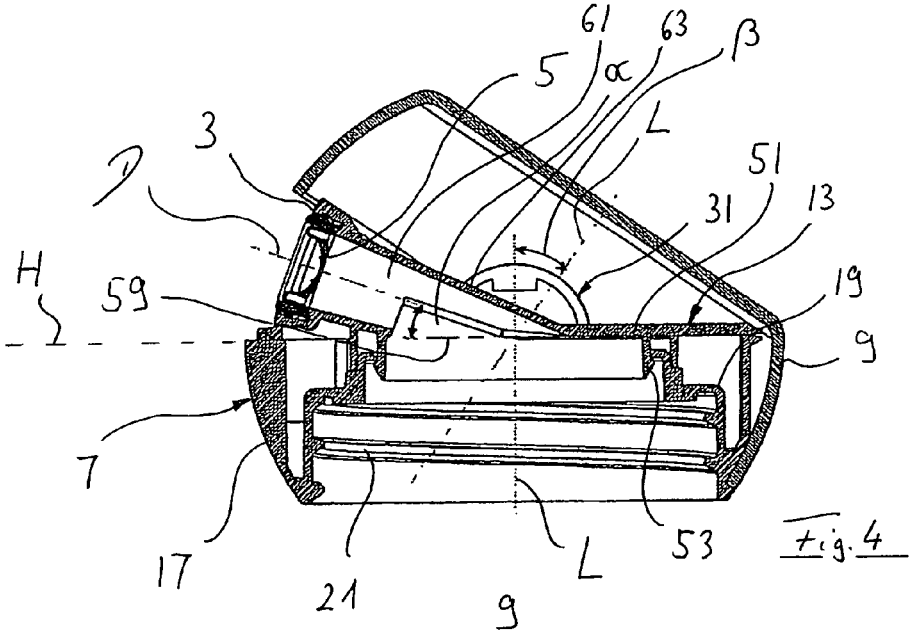
FIG. 4 is a cross sectional view of the dispensing closure according to FIG. 2 in an open position.
Figure 5:
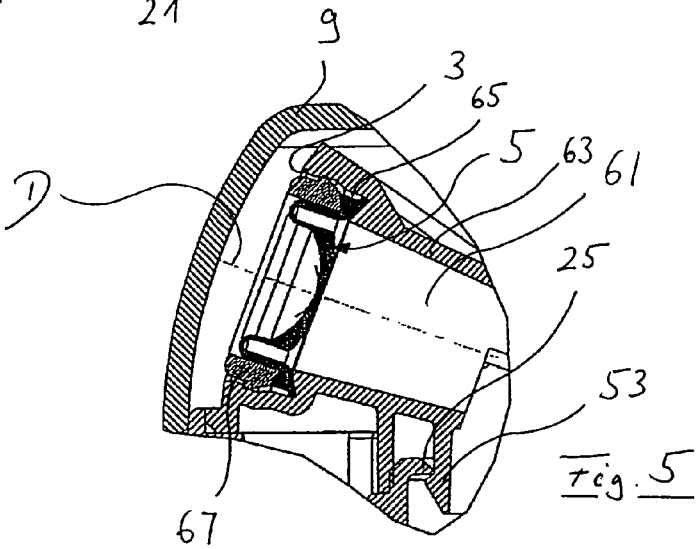
FIG. 5 is an enlarged cross sectional view of section V in FIG. 3.

In FIGS. 3 and 4, the deck structure 13 is in its mounted dispensing position in which the deck structure 13 is immovably fixed to the neck structure 7. The horizontal basic wall 51 is formed with a inlet port 59 extending from the center axis L radially outwardly and being the first inner end of an discharge channel 61 defining a longitudinal linear discharging direction D that is inclined to the horizontal by an inclination angle $\alpha$ which is about 15° to 20°. The inclination angle $\alpha$ does not change and is constant with respect to the horizontal H, regardless the actuation state of the toggle-action actuator 9 as is visible when regarding FIGS. 3 and 4. The deck structure 13 and therefore the discharge channel 61 is immovably fixed to the neck structure 7 while the toggle-action actuator 9 is pivotally connected to the neck structure 7. As the inclination angle $\alpha$ remains stable during the entire dispensing condition of operation, the handling of the container provided with a closure 1 is uniform regardless the toggle-action actuator 9 is just opened or was already open. In the open position of the toggle-action actuator 9, an tilt angle $\beta$ of the center line L with respect to the vertical or the longitudinal axis L of the closure is achieved the tilt angle being larger than the inclination angle $\alpha$.

The discharge channel 61 is confined by a revolving channel wall 63 that is cylindrically or cone like shaped. The cone like channel wall 63 slightly increases in diameter from the inlet port 59 to the outlet port 3 of the discharge channel 61. The channel wall 63 at the outlet port 3 is formed with a ring seat 65 (FIG. 5) in which a foot portion of the rolling sleeve 5 is press fitted by a snap ring 67.

If no valve 5 is foreseen, the innerside of the wall of the toggle-action actuator 9 is formed with a sealing nose opposite the outlet 3 and formed to fit into the outlet port 3 of the discharge channel 61 of the deck structure 13.

When dispensing the toggle-action actuator 9 is manually operated such it is tilted from the closed position (FIG. 3) into the open position (FIG. 4) thereby vacating the outlet port 3. The closure 1 and the container are preferably in an vertical up-side-down position. When squeezing the container the medium will flow through the inlet port 59 via the discharge channel 61 to the outlet port 3. If the dispense use is finished the end user can close the toggle-action actuator 9 by tilting it back into the closed position.

For charging the container with medium, in a first step, the toggle-action actuator 9 is demounted and separated from the neck structure 7. In a second step, the locking hook 53 is released from the charging opening 23. In the third step, the deck structure 13 is pivoted in its open charge position so that the charging opening is totally vacant from the deck structure 13.

It will be readily apparent from the foregoing detailed description of the invention and from the illustrations thereof that numerous variations and modifications may be effected without departing from the principal aspects of the invention.

LIST OF REFERENCE NUMERALS

1 dispensing closure
3 outlet
5 valve
7 neck structure
9 toggle-action actuator
11 flat top surface
13 deck structure
17 outer wall section
19 inner wall section
21 internal thread
23 charging opening
24 undercut
25 protrusion
31 pivot joint
33 receiving wall portion
35 pivot hole
37 pivot pin
41 passage

43 slanted surfaces
45 depressions
47 protrusion
49 engaging wall portion
50 film hinge
51 horizontal basic wall
53 annual hook
59 inlet port
61 discharge channel
63 channel wall
65 ring seat
67 snap ring
H horizontal
L longitudinal (center) axis
$P_{1,2}$ pivot axis
α inclination angle
β tilt angle

What is claimed is:

1. A dispensing closure (1) for an opening of a container wherein said closure comprises:

a dispensing condition of operation and a charging condition of operation;

a neck structure (7) for fixing the closure to a container or for being fixed to a container;

an outlet port (3) for communicating with an opening of said container; an actuator (9) movably mounted on said neck structure (7) between a closed position for occluding said outlet port (3) and an open position for vacating said outlet port (3) when a force is applied to said actuator (9);

a deck structure (13) extending from said neck structure (7) transversely over said opening and forming a discharge channel (61) extending substantially linearly from said outlet port (3) to said opening and defining a longitudinal discharge direction, said movable actuator (9) occluding said discharge channel (61) in said closed position and vacating said discharge channel (61) in said open position, said longitudinal discharge direction of the discharge channel (61) being inclined to a horizontal (H) in an acute inclination angle (α), and in the dispensing condition of operation the deck structure (13) being immovably fixed to the neck structure (7) in between the actuator (9) and the neck structure (7) such that regardless the position of the actuator (9) the inclination angle (α) remains unchanged;

wherein said closure further comprises a first pivot joint (31) for pivotally supporting said actuator (9) on said neck structure (7);

a locking means for releasably fixing said deck structure (13) to said neck structure (7); and a second pivot joint (50) between said deck structure (13) and said neck structure (7), and wherein said deck structure (13) is arranged bet actuator (9) and said neck structure (7) in such a way that when said actuator (9) is detached from said neck structure (7) and said locking means are released said deck structure (13) be pivoted second pivot joint (50) between a mounting position and a release position in which said opening of said container is essentially uncovered by said deck structure (13).

2. The dispensing closure (1) according to claim 1 wherein the actuator (9) forms a particularly flat outside surface (11) for depositing the container in an upright up-side-down-position, wherein in the closed position of the actuator (9) the flat outside surface (11) is horizontal and in the open position the flat outside surface (11) is inclined to the horizontal (H) in an acute open angle (β) that is larger than the inclination angle (α).

3. The dispensing closure (1) according to claim 1 wherein the inclination angle (α) is one of; (a) an angle that is smaller than 45°; (b) an angle that is between 1° to 85°; (c) an angle that is between 5° to 60°; and (d) an angle that is between 10° to 30°.

4. The dispensing closure (1) according to claim 1 wherein the discharge channel (61) is confined by an at least partly revolving channel wall (63) having one of a cylindrical and a cone shaped form and wherein the channel cross-section increases to the outlet port (3).

5. The dispensing closure (1) according to claim 1 wherein said discharge channel defines an inlet port (59) facing said opening and being at least partly confined by an horizontal wall (51) of the deck structure (13), wherein the discharge channel (61) extends with its horizontal component of direction radially outwardly.

6. The dispensing closure (1) according to claim 1 wherein said first pivot joint (31) comprises a pair of pivot pins (37) each retained on an engaging wall portion (49) of the actuator (9) at least partly overlapping the outside of a receiving wall portion (33) of the neck structure (7) wherein particularly the engaging (49) and receiving (33) wall portions are complementarily shaped.

7. The dispensing closure (1) according to claim 6 wherein both engaging wall portions (49) are elastically deformable such that they can be spread radially outwardly for disengaging the pivot pins (37) from respective pivot holes (35) formed in the neck structure (7).

8. The dispensing closure (1) according to claim 1 wherein said first pivot joint (31) comprises snap means (47) having at least two snap positions (45) defining the open and closed position of the actuator (9).

9. The dispensing closure (1) according to claim 1 wherein both pivot joints (31, 50) define each a pivot axis ($P_1$, $P_2$) which are parallel to each other.

10. The dispensing closure (1) according to claim 1 wherein the second pivot joint (50) is realized by a film hinge.

11. The dispensing closure (1) according to claim 1 wherein the second pivot joint (50) is arranged diametrally oppositely to the outlet port (3).

12. The dispensing closure (1) according to claim 1 wherein the second pivot joint (50), a pair of pivot pins (37) for the first pivot joint (31) and the outlet port (3) are positioned essentially in identical perimeter distances particularly of about 90° around a center axis (L) of the closure (1).

13. The dispensing closure (1) according to claim 1 wherein the locking means is formed by an annular deformable catch or hook (53) that in the mounting position of the deck structure (13) snappingly engages a ring wall (25) of the neck structure (7) for releasingly fixing the deck structure (13) to the neck structure (7).

14. The dispensing closure (1) according to claim 1 wherein the neck structure (7) and the deck structure (13) are integrally formed of one piece of plastic.

15. The dispensing closure (1) according to claim 1 further comprisinq a valve (5) positioned at the outlet port (3) of the discharge channel (61), and said valve (5) is a slotted roll diaphragm.

16. The dispensing closure (1) according to claim 15 further comprising a revolving channel wall portion (63) is formed with a seat (65) for receiving said valve (5), said valve is retained in the seat (65) by a ring (67), said ring being one of: (a) a snap ring; (b) a press ring; and (c) a ring moulded integrally with said seat (65) by means of a two-component injection moulding.

17. The dispensing closure (1) according to claim wherein both the deck structure (13) and the neck structure (7) comprise a partly spherical outside wall being formed to shape a partly spherical body for the closure (1).

18. The dispensing closure (1) according to claim wherein the neck structure (7) comprises a partly spherical recess in a spherical outside wall portion for receiving a corresponding spherical outside wall portion of the actuator (9) when the actuator (9) is in the open position wherein a depth of the recess corresponds essentially to a thickness of the received outside wall portion of the actuator (9).

19. The dispensing closure (1) according to claim 18 wherein said recess is confined by a shoulder acting as a stop for limiting the pivoting of the actuator (9) and defining the open position of the actuator (9).

* * * * *